US005296005A

United States Patent [19]

Wolfe et al.

[11] Patent Number: 5,296,005

[45] Date of Patent: Mar. 22, 1994

[54] PROCESS FOR CONVERTING COAL INTO LIQUID FUEL AND METALLURGICAL COKE

[75] Inventors: Richard A. Wolfe; Chang J. Im, both of Abingdon, Va.; Robert E. Wright, Bristol, Tenn.

[73] Assignee: Coal Technology Corporation, Bristol, Va.

[21] Appl. No.: 951,136

[22] Filed: Sep. 25, 1992

Related U.S. Application Data

[63] Continuation-in-part of Ser. No. 614,085, Nov. 15, 1990, Pat. No. 5,151,159.

[51] Int. Cl.[5] ..... C10L 5/16

[52] U.S. Cl. ..... 44/551; 44/564; 44/591; 44/281; 585/14

[58] Field of Search ..... 44/550, 551, 564, 591, 44/281; 585/14

[56] References Cited

U.S. PATENT DOCUMENTS

| | | | |
|---|---|---|---|
| 1,276,428 | 8/1918 | Smith | 44/550 |
| 3,184,293 | 5/1965 | Work et al. | 44/591 |
| 4,671,800 | 6/1987 | Meyer et al. | 44/281 |
| 4,704,134 | 11/1987 | Meyer et al. | 44/281 |

*Primary Examiner*—Prince Willis, Jr.
*Assistant Examiner*—Cephia D. Toomer
*Attorney, Agent, or Firm*—Veal & Associates

[57] ABSTRACT

A method of recovering coal liquids and producing metallurgical coke utilizes low ash, low sulfur coal as a parent for a coal char formed by pyrolysis with a volatile content of less than 8%. The char is briquetted and heated in an inert gas over a prescribed heat history to yield a high strength briquette with less than 2% volatile content.

11 Claims, 3 Drawing Sheets

PROCESS FOR CONVERTING COAL INTO LIQUID FUEL AND METALLURGICAL COKE

This is a continuation in part of U.S. Pat. application Ser No. 07/614,085, filed Nov. 15, 1990, now U.S. Pat. No. 5,151,159.

FIELD OF THE INVENTION

The present invention relates to the production of fuels, and more particularly relates to the production of alternate fuels from coal. In even greater particularity the invention relates to the production of a liquid fuel and a metallurgical coke from coal.

BACKGROUND OF THE INVENTION

The present invention is directed to a process which utilizes the apparatus disclosed in U.S. Pat. No. 5,151,159 which is commonly owned with the instant application and which is incorporated herein by reference. Although numerous other attempts have been made at producing alternate fuels from coal, the known methods and processes leave something to be desired in terms of the volatile content of the coke and the heat history of the process which in turn reflects the cost and efficiency of the process.

Coal heated to selected temperatures in the absence of air yields coal gas, coal liquids and a residue char. Yield of the three products will vary with the temperature at which the coal is heated and the duration of time such heating is conducted. Typically such a process is facilitated by repetitively introducing batches of coal into a retort wherein the coal is heated for a period of up to 18 hours. Volatile hydrocarbon gases are released from the heated coal and are condensed into coal liquids. The remaining char is mixed with various binders and calcined to form coke for use in a blast furnace.

The batch process is usable, however, under the current economic environment, is not efficient enough to produce a satisfactory amount of coke or coal fuel to economically justify its practical application as an alternative fuel producing mechanism.

In response to this economic dilemma, various apparatus for continuously conveying coal through a retort have been devised. Conveyors and screw mechanisms are the most common. The most visible problem with these conveying apparatus is that coal assumes a plastic consistency during the pyrolyzation stage and clings to the conveyor or screw to form a residue layer that reduces the rate of conveyance of coal through the retort and eventually impairs the efficient distribution of heat through the coal being conveyed therethrough. The plasticity of heated coal also creates technical problems that hinder the continuous conversion of the char produced in the retort into an industrial metallurgical coke.

U.S. Pat. No. 1,481,627 issued to Smith discloses a method for treating coal and manufacturing briquettes wherein briquettes are calcined at approximately 1850° F. Pitch is added to char to bind the briquette and to raise the percentage of volatile hydrocarbons comprised therein.

U.S. Pat. No. 3,178,361 issued to Bailey discloses apparatus having a plurality of screws for facilitating the continuous carbonization of coal. The coal is heated at temperatures ranging from 500° to 600° F.

U.S. Pat. No. 3,251,751 issued to Lindahl et al. discloses a process for carbonizing coal using screws for conveying the coal through a retort.

U.S Pat. No. 3,401,089 issued to Friedrich et al. discloses a process for making form coke by agglomerating discrete carbonaceous particles in a tumbling zone of a rotating retort including carbonaceous particles previously subjected to agglomeration in said tumbling zone. The process includes the steps of introducing finely divided caking bituminous coal, pitch binder and solid distillation residue of coal into the tumbling zone and calcining the mixture to form coke.

U.S. Pat. No. 3,403,989 issued to Blake et al. discloses a process for producing briquettes from calcined char, wherein the briquettes comprise 75% to 90% char.

U.S. Pat. No. 4,094,746 issued to Masciantonio et al. discloses a coal conversion process using liquefaction techniques and gas separation of coal liquids liberated by such liquefaction processing.

Exemplary of current coal conversion processes and apparatus is U.S. Pat. No. 4,395,309 issued to Esztergar. Esztergar teaches means for conveying coal over a screen encased within a retort. Heating elements above the screen pyrolyze coal causing volatile hydrocarbon to escape the retort for separation into various grades of oil.

It is very important that a chosen pyrolyzation and coke forming process produce coke that has a coke reactivity index (CRI) less than 30 and a coke strength after reaction (CRS) greater than 55. Though no official standard has been recognized to indicate at what grades coke is satisfactory for use in a blast furnace, it is recognized that coke having the aforementioned CRI and CSR ratings is high grade coke that is more than adequate for use in blast furnace operation.

CRI is determined by reacting 200 grams of $\frac{3}{4}'' \times \frac{7}{8}''$dry coke with carbon dioxide adjusted to a flow rate of 5 liters/minute for two hours at 1100° C. (2012° F.). CRI is reported as the percent weight loss of the coke sample after this reaction.

CSR is determined by tumbling the coke used during the CRI test in a drum for 600 revolutions at 20 RPMs. The cumulative percent of plus $\frac{3}{8}''$ coke after tumbling is reported as the CSR.

Variations in carbonization and calcining temperatures, residency time, briquetting pressures and the selection of binding materials mixed with the char to form coke all effect the resultant CRI and CSR of the resultant coke. Closely controlled manipulation of the coal throughout the entire procedure is a necessity for producing a high grade coke having minimal CRI and maximum CSR levels.

SUMMARY OF THE INVENTION

It is the object of the present invention to produce coke to meet the specification for use in steel industry blast furnaces.

Another object of the invention is to make such coke in a process that does not emit toxic gases or liquids to the environment.

Yet another object is to produce such coke and recover coal liquid by-products for use as gasoline or diesel engine fuels or as additives for motor fuels.

Still another object is to convert special coal types to char for use in the ferro-silicon and ferro-alloy industries.

These and other objects and advantages of the present invention are accomplished by introducing a stream of coal into a coal crusher, wherein the coal is reduced to a particle size approximately ¼"×0 or ⅛"×0. The coal particles are then conveyed through an airlock to a pyrolyzer unit into which the coal particles are fed at a selected rate. The coal pyrolyzer includes a retort chamber having a pair of interfolded screw conveyors rotatably connected therein to convey coal therethrough at the selected rate. The screws rotate in opposite directions with such rotation being intermittently reversed to prolong the residence time of the coal within the retort chamber.

The temperature within the retort chamber is maintained at about 1400° F. by a gas furnace encasing the retort chamber and electrical heating elements received within each screw's drive shaft. The residence time of the coal in the coal pyrolyzer is approximately twenty minutes. Heating the coal to such high temperatures softens the coal to a plastic consistency and results in the collection of coal residue on the drive screws. A lost motion clutch is connected to one of the screws to periodically bring the screw's spiral flights in contact to scrape away any coal residue adhering thereto. Apertures in the top of the retort chamber serve as vents through which volatile hydrocarbon gases, released from the pyrolyzed coal, may escape.

Thermocouples are located at the discharge end of the predryer, at the mid-point of the coal pyrolyzer, at the discharge end of the pyrolyzer, proximal the electric heating elements, in the furnace and proximal the connection of the screws with the retort chamber. These thermocouples sense heat and correspondingly adjust the temperature of the furnace to regulate the temperature within the retort chamber and the predryer.

Gases released from the coal being conveyed through the predryer and the retort are piped to a condenser wherein the gases are separated into condensable coal liquids, water vapor and non-condensable gases. The water vapor and non-condensable gases are conducted through a scrubber wherein the water vapor is separated from the non-condensable gases which are used for fuel in the furnace. The condensable coal liquids are introduced into a separation unit wherein the condensable coal liquids are separated into volatile hydrocarbon motor fuels and motor fuel supplements.

The solid portion of the coal remaining after the volatile hydrocarbon gases and water vapor have been removed is referred to as char. The char is discharged from the coal pyrolyzer and introduced into a char cooler whose sole function is to cool the char below a temperature at which the char will ignite when exposed to air. The cooled char is conveyed to a char delumper which pulverizes the cooled char for easier handling. The char particles are conveyed through a second airlock which in combination with the first airlock isolates the predryer, the coal pyrolyzer, the char cooler and the char delumper from the atmosphere and more specifically the oxygen transported therein. After passing the second airlock, the char is conveyed to a char mixer wherein the char is combined with selected binder materials. The mixture of char and binders is conveyed to a briquette machine which forms the char and binders into briquettes. The briquettes are introduced into a coking oven wherein the briquettes are calcined over a specific heat history to form metallurgical coke. The coke briquettes are subsequently cooled to a temperature low enough so they will not ignite when exposed to air and are thereafter ready for use in a blast furnace.

BRIEF DESCRIPTION OF THE DRAWINGS

Apparatus embodying features of our invention are depicted in the accompanying drawings which form a portion of this disclosure and wherein.

DESCRIPTION OF A PREFERRED EMBODIMENT

Figure 1A:
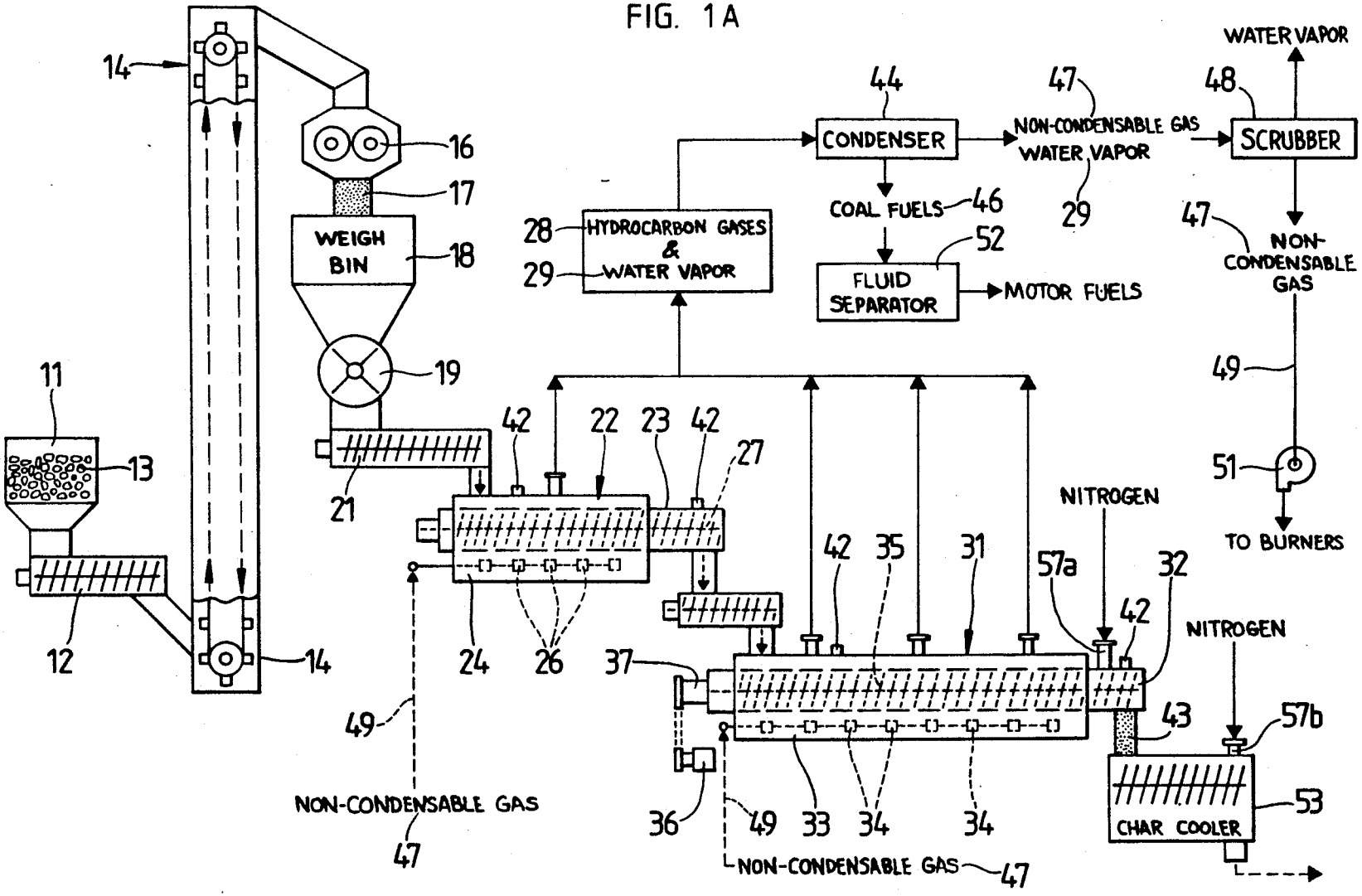
FIG. 1A and 1B in combination are schematic views of the present invention.

Referring to the drawings for a clearer understanding of the invention, it should be noted in FIG. 1A that the present invention contemplates the use of a first feed screw conveyor 12 connected to the coal receiving hopper 11 for conveying coal 13 deposited therein to a bucket elevator 14. The coal 13 is conveyed to a higher elevation by the bucket elevator 14 and discharged into a coal crushing unit 16 connected thereto. The coal 13 is reduced to coal particles 17 of predetermined size, preferably ¼"×0 or ⅛"×0 by the crusher 16 and is subsequently introduced into a first weighing bin 18 wherein the unit weight of the coal particles 17 is measured. The coal particles 17 fall from the first weighing bin 18 through a first airlock 19 connected thereto. A second feed screw conveyor 21, connected to the first airlock 19, receives the coal particles 17 therefrom and conveys the coal particles 17 to a predryer 22 connected to the second feed screw conveyor 21.

The predryer 22 includes a drying chamber 23 encased within a drying furnace 24 having a plurality of burners 26 mounted therein. The drying chamber 23 has a drive screw 27 rotatably mounted therein and driven in a selected angular direction for conveying the coal particles 17 through the drying chamber 23 at a predetermined rate. The temperature in the drying chamber 23 is maintained equal to or less than 400° F. to release a portion of the volatile hydrocarbon gases 28 and water vapor 29 typically incorporated within the coal particles 17. A coal pyrolyzer 31 is hermetically connected to the predryer 22 and receives the coal particles 17 discharged therefrom.

Figure 1B:
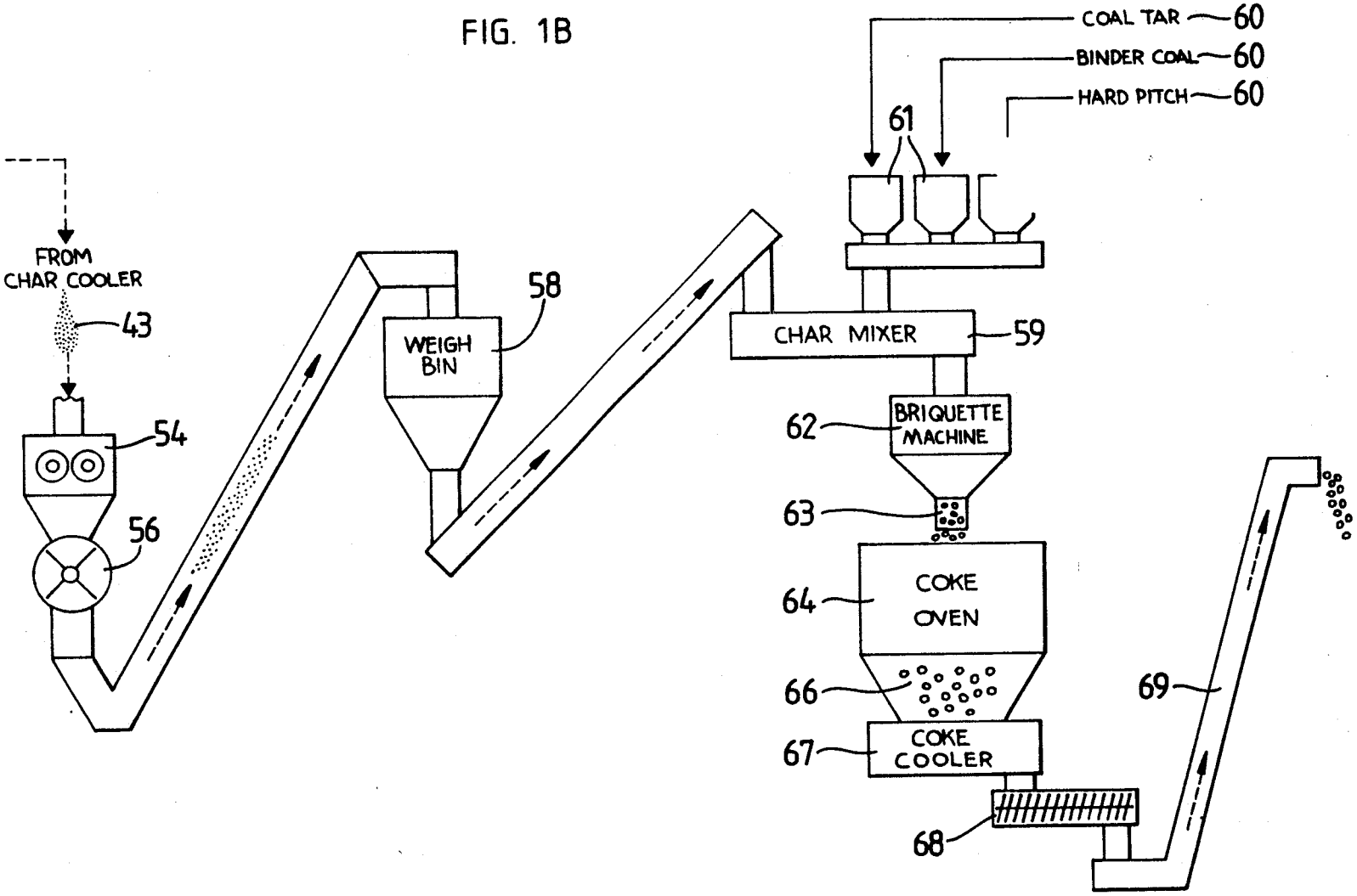

As shown in FIGS 1A and 1B, the coal pyrolyzer 31 includes a retort chamber 32 hermetically connected to and in communication with the predryer 22 and encased within a pyrolyzing furnace 33 having burners 34 mounted therein for producing a gas fueled flame. A pair of parallel interfolded drive screws 35 are rotatably mounted within the retort chamber 3 for conveying the coal particles 17 therethrough. A motor 36 is connected to the drive screws 35 for rotating the same. At predetermined intervals, the motor reverses the rotation of the drive screws 35 to prolong the residence time during which the coal particles 17 remain in the retort chamber 32.

Each drive screw 35 includes a tubular drive shaft on which a flight is connected in spiraling relation thereto. The flights are interfolded, thus the reduction in rotational speed of the predetermined drive screw causes the interfolded flights to temporarily contact and dislodge coal residue collected thereon. As shown in FIG. 1A, thermocouples 42 are connected to the drying chamber 23, the retort chamber 32, the drive screws 35, the drying furnace 24 and the pyrolyzing furnace 33 to monitor temperature and to automatically regulate the drying furnace 24, the pyrolyzing furnace 33 and the electric elements to maintain the temperatures generated thereby at selected levels.

The retort chamber 32 is heated to 1400° F. or higher to pyrolyze the coal particles 17 passing therethrough and to release the remaining volatile hydrocarbon gases 28 and water vapor 29 incorporated within the coal particles to less than 8%. Devolatilized coal residue or char 43 is discharged from the retort chamber 32 by the drive screws 35.

As shown in FIG. IA, a condenser 44 is connected to and in communication with the retort chamber 32 and the drying chamber 23 to receive the hydrocarbon gas 28 and water vapor 29.

The condenser stage 44 should be able to hold the circulating cool liquids (hydrocarbon gases and water vapor) within a temperature range of about 215° F. to 235° F. such that water vapor and other low boiling point liquids such as benzene and toulene vapors are not able to condense with the desired coal liquids which have higher boiling points. A second condenser may be used to condense the lower boiling liquids, thereby simplifying further refining of the cool liquids and the low boiling liquids.

A scrubber unit 48 is connected to and in communication with the condenser 44 to receive and separate the non-condensable gases 47 from the remaining water vapor 29. A plurality of tubular conduits 49 and a gas pump 51 are operatively connected intermediate to and in communication with the scrubber unit 48 and the drying and pyrolyzing furnaces 23 and 33 for conveying the non-condensable gases 47 from the scrubber 48 to the burners 26 for use as a fuel.

A fluid separator unit 52 is connected to and in communication with the condenser 44 for receiving the coal fuels 46 therefrom and converting the coal fuels 46 into selected motor fuels.

Char 43 discharged from the coal pyrolyzer 31 is received within a char cooler 53 hermetically connected to the coal pyrolyzer 31. The char cooler 53 cools the char 43 to a brittle consistency and to a temperature below that which the char would ignite if exposed to air. As shown in FIGS. 1A and 1B, a char delumper 54 is hermetically connected to the char cooler 53 and receives the char 43 therefrom to pulverize the char 43 to a powdered consistency. As shown in FIG. 1B pulverized char 43, discharged from the delumper 54, passes through a second airlock 56 hermetically connected to the delumper 54. The second airlock 56 in combination with the first airlock 19 isolates atmospheric gases from the pyrolyzer, the char cooler and the pulverizer, thereby preventing the combustion of the coal particles 17. Nitrogen gas is piped through portals **57*a* and 57*b* into the pyrolyzer 31 and the char cooler 53**, respectively, to assure that the predryer, pyrolyzer and char cooler are free of atmospheric air.

Pulverized char 43 discharged from the second airlock 56 is conveyed to a second weighing bin 58 for determining the unit weight of the char 43. After weighing, the char 43 is conveyed to a char mixer 59 which mixes the char 43 with selected binders 60. A plurality of binder receiving hoppers 61 are connected to the char mixer 59 for receiving selected binders 60. The binders 60 preferred for use with the present invention include binder coal, coal tar and hard pitch, however those skilled in the art will recognize that other binders can be used with the present apparatus. The char 43 and selected binders are mixed at temperatures ranging from 125° F. to 200° F.

After mixing, the char 43 and binders 60 are introduced into a briquette machine 62 which compresses the binders 60 and char 43 into briquettes 63. The briquettes 63 are introduced into a coke oven 64 which heats the briquettes 63 in accordance with a preferred heat history, thereby calcining the briquettes into high grade metallurgical coke 66. A coke cooler 67 is connected to the coke oven 64 to receive and cool the coke 66 to a temperature at which the coke 66 can be easily handled and to a temperature at which the coke 66 will not ignite when exposed to air. A third feed screw conveyor 68 is connected to the coke cooler 67 to receive the coke 66 discharged therefrom and convey the coke 66 to a loading conveyor 69.

It should be remembered that coke also acts to provide a permeable bed to permit the proper flow of gases through the blast furnace. To meet this requirement, coke should be narrowly sized, have an adequate mean size, should not pack too closely and should degrade as little as possible during its residence in the blast furnace. A void factor of 0.50 is desired and is preferably achieved in one of two ways: In the first, the briquette machine 62 may actually be three or more machines, each forming different size briquettes to yield the void factors. In the second method, much larger briquettes are made, pulverized as with a roll crusher and screened to the appropriate sizes.

It should also be noted that special types of coal must be selected for producing char for ferro-silicon or ferro-alloy uses. Our method requires the use of a coal having qualities equivalent to Pocahontas #3 coal in terms of low ash, low iron, low calcium, low aluminum, low titanium and low sulfur content. In the blast furnace it is important to maximize the carbon content of the coke, thus the present coal is selected to have the lowest possible ash and sulfur content.

The prior art indicates that a two hour cure of the briquettes in oven 64 at 450° F. in air would harden and strengthen the briquettes by converting the binder to an infusible polymer. We have found this to be otherwise with our materials. Our test results are set forth hereinafter.

A control group of briquettes were made using 60% Pocahontas char, 30% Knox Creek binder coal, 5% CMBU tar and 5% Allied 110 degree C pitch. The oven was filled half full of green briquettes and heated to 450° F., whereupon the briquettes were allowed to soak for two hours. The oven was then opened and filled with green briquettes. The oven was then heated to 850° F. (i.e. maximum briquette fluidity) in an inert atmosphere and held for one hour. The temperature was then increased to 1832° F. and held for one and one half hours. Upon cooling the coke was removed. Thus the 450° air cured briquettes had a heat history of five and one half hours including ramp times between heat stages. The briquettes which were cured at 850° only in an inert atmosphere had a total heat history of three and one half hours. Next the oven was loaded with green briquettes and heated to 1832° F. as rapidly as possible and held for an hour and a half before the briquettes were allowed to cool and be removed. Table 1 shows the results.

TABLE 1

| Briquette | Total Heat History | Crush Strength | Volatile Content |
|---|---|---|---|
| 450° Air Cure | 5½ hrs. | 1545 lbs. | 1.01% |
| 805° Inert Cure | 3½ hrs. | 2772 lbs. | 0.72% |

TABLE 1-continued

| Briquette | Total Heat History | Crush Strength | Volatile Content |
|---|---|---|---|
| Non Cured | 2½ hrs. | 1500 lbs. | 4.76% |

From the foregoing it may be seen that for the low ash low sulfur coal used the 450° air soak does not provide any benefit and appears to drive off binder. On the other hand allowing the binder coal to go through the 850° inert gas soak yields a coke that is 80% stronger than the air cured or non cured briquettes and a lower volatile matter content than either.

Note also that, in as much as the non cured briquettes had a much higher volatile content, it is clear that adding the 850° cure period will lengthen the total heat history temporarily but will reduce the energy costs required to obtain coke with less than 2% volatile matter content.

Further, the 850° cured coke had a CSR test of as high as 69 as confirmed by an independent laboratory.

Figure 2:
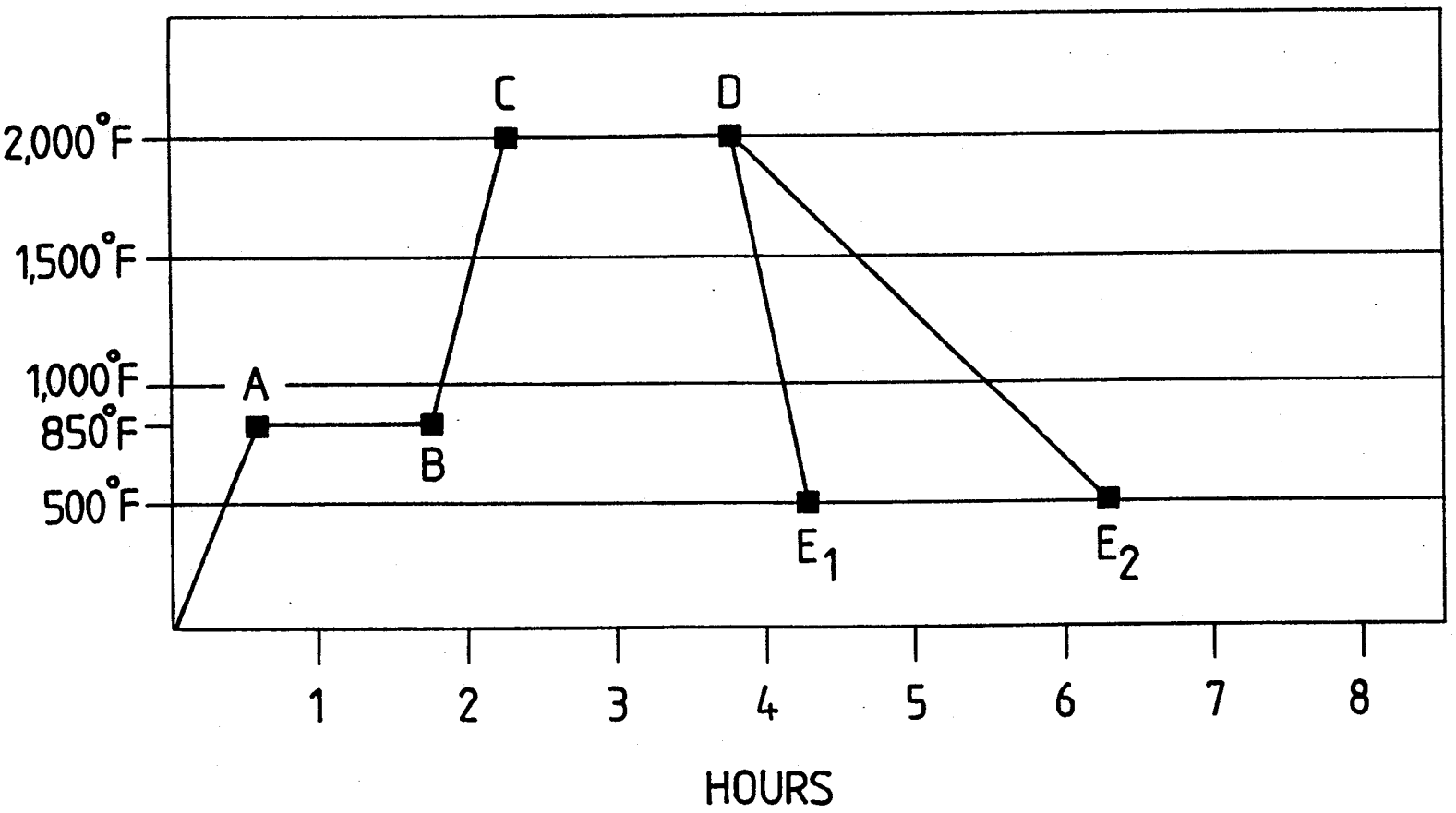
FIG. 2 is a depiction of the specific temperature sequence of the briquettes.

In actual practice coke oven 64 would utilize a two stage rotary hearth calciner, or a vertical multi hearth calciner, or a chain grate furnace for the 850° heat soak, discharging into a rotary hearth furnace for the 1832° heat soak. When a rotary furnace is used a chain grate cooler may be used to cool to point E on FIG. 2. The rate of cooling may be adjusted as desired between $E_1$ and $E_2$.

While we have shown our invention in one form, it will be obvious to those skilled in the art that it is not so limited but is susceptible of various changes and modifications without departing from the spirit thereof.

What we claim is:

1. A method for producing metallurgical coke and liquid coal fuels from coal comprising the steps of:

(a) selecting a parent coal with a low ash and low sulfur content equivalent to Pocahontas #3 coal;

(b) reducing said parent coal to particulate;

(c) pyrolyzing said particulate coal at about 1400° F. in an inert gas to produce a char of less than 8% volatile matter content while extracting volatile coal liquids and other liquid;

(d) condensing and recovering said coal liquids at a temperature above 215° F.; and (e) forming calcined coke briquettes from said char, whereas said briquettes are formed with 60% char from said parent coal and 40% of a binder coal.

2. A method as defined in claim 1 wherein said coal liquids are condensed at a temperature between about 215° F. and 235° F.

3. A method as defined in claim 1, wherein said briquettes are formed with a binder coal equivalent to Knox Creek binder coal, and said briquettes are cured at 850° F. in an inert atmosphere.

4. A method as defined in claim 1 wherein said briquettes are heated to 850° F. and held at 850° F. for a period of time, then heated to about 1832° F. for a second period of time before cooling.

5. A method as defined in claim 4 wherein said heating occurs in an inert atmosphere.

6. A method as defined in claim 4 wherein said parent coal is selected from coals having an ash and sulfur content equivalent to Pocahontas #3 coal.

7. A method as defined in claim 3 wherein said parent coal is selected from coals having an ash and sulfur content equivalent to Pocahontas #3 coal.

8. A method of forming coke from coal comprising the steps of:

(a) selecting a parent coal having a low ash and low sulfur content;

(b) reducing said coal to a char having less than 8% volatile content;

(c) forming briquettes wherein said briquettes consist of about 60% by weight said char, about 30% binder coal, about 5%, tar; and about 5% pitch; and (d) subjecting said briquettes to a heat history wherein said briquettes are heat soaked at the maximum fluidity temperature of the briquette of about 850° F. for a period and then heated at a higher temperature of about 1832° F. for a second period prior to cooling.

9. The method as defined in claim 8 wherein said parent coal is selected from coals having an ash and sulfur content equivalent to Pocahontas #3 coal.

10. The method as defined in claim 8 wherein said briquettes are heat soaked at said first period in an inert gas.

11. The method as defined in claim 10 wherein said first period is about one hour and said period is about one and one half hours.

* * * * *